US009511828B1

(12) United States Patent
Branch

(10) Patent No.: US 9,511,828 B1
(45) Date of Patent: Dec. 6, 2016

(54) PERSONAL SAFETY SURVIVAL DEVICE

(71) Applicant: John Branch, Warren, PA (US)

(72) Inventor: John Branch, Warren, PA (US)

( * ) Notice: Subject to any disclaimer, the term of this patent is extended or adjusted under 35 U.S.C. 154(b) by 0 days.

(21) Appl. No.: 14/532,049

(22) Filed: Nov. 4, 2014

(51) Int. Cl.

| | |
|---|---|
| ***B63C 9/06*** | (2006.01) |
| ***B63C 9/03*** | (2006.01) |
| ***B63B 45/00*** | (2006.01) |
| *B63C 9/04* | (2006.01) |

(52) U.S. Cl.
CPC . *B63C 9/03* (2013.01); *B63C 9/21* (2013.01); *B63C 2009/042* (2013.01); *B63C 2009/044* (2013.01)

(58) Field of Classification Search
CPC ..... E04H 15/20; B63C 9/065; B63C 9/06
See application file for complete search history.

(56) References Cited

U.S. PATENT DOCUMENTS 2,656,844 A * 10/1953 Kreuzer ..... A47G 9/086 135/90
2,830,606 A * 4/1958 Daugherty ..... E04H 15/20 119/436
3,457,684 A * 7/1969 Wood, Jr. ..... E04H 15/20 52/2.21
3,768,761 A 10/1973 Cramer
3,877,096 A 4/1975 Scesney
4,607,655 A * 8/1986 Wagner ..... E04H 15/20 135/116
4,645,465 A 2/1987 Courtney
4,750,447 A * 6/1988 Spinosa ..... B63C 9/06 114/345
4,775,119 A 10/1988 Aronne
5,123,434 A * 6/1992 Fetterly ..... E04H 15/20 135/20.2
D415,992 S 11/1999 Polley
7,056,179 B2 6/2006 Courtney
8,011,986 B1 * 9/2011 Curtsinger ..... B63B 35/732 441/35
8,070,543 B1 12/2011 Faletra
2011/0177732 A1 7/2011 Clifford

* cited by examiner

*Primary Examiner* — Edwin Swinehart

(57) ABSTRACT

The personal safety survival device includes a plurality of elongated inflation members that collectively form a triangular enclosure. The triangular enclosure has an opening at distal ends, which enables an end user to climb into the triangular enclosure. The personal safety survival device includes an auto-inflation system that inflates the triangular enclosure when triggered, and is to be used as a life raft that keeps the end user out of water, and safe from drowning. The auto-inflation system includes a CO2 canister in fluid communication with all the elongated inflation members. Each of the elongated inflation members include a manual inflate nozzle. When deflated, the personal safety survival device is able to be rolled up into a relatively small size, and includes a carrying strap as well as a pull cord.

4 Claims, 6 Drawing Sheets

PERSONAL SAFETY SURVIVAL DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of survival equipment, more specifically, an auto-inflating device that is able to provide a place of refuge when inflated.

SUMMARY OF THE INVENTION

An embodiment of the disclosure meets the needs presented above by generally comprising a plurality of elongated inflation members that collectively form a triangular enclosure. The triangular enclosure has an opening at distal ends, which enables an end user to climb into the triangular enclosure. The personal safety survival device includes an auto-inflation system that inflates the triangular enclosure when triggered, and is to be used as a life raft that keeps the end user out of water, and safe from drowning. The auto-inflation system includes a CO2 canister in fluid communication with all the elongated inflation members. Each of the elongated inflation members include a manual inflate nozzle. When deflated, the personal safety survival device is able to be rolled up into a relatively small size, and includes a carrying strap as well as a pull cord. The pull cord is used to trigger the auto-inflation system. The distal ends may include a curtain member that includes a drawstring in order to close off a circular opening in the curtain member.

These together with additional objects, features and advantages of the personal safety survival device will be readily apparent to those of ordinary skill in the art upon reading the following detailed description of presently preferred, but nonetheless illustrative, embodiments of the personal safety survival device when taken in conjunction with the accompanying drawings.

In this respect, before explaining the current embodiments of the personal safety survival device in detail, it is to be understood that the personal safety survival device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personal safety survival device.

It is therefore important that the claims be regarded as including such equivalent construction insofar as they do not depart from the spirit and scope of the personal safety survival device. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
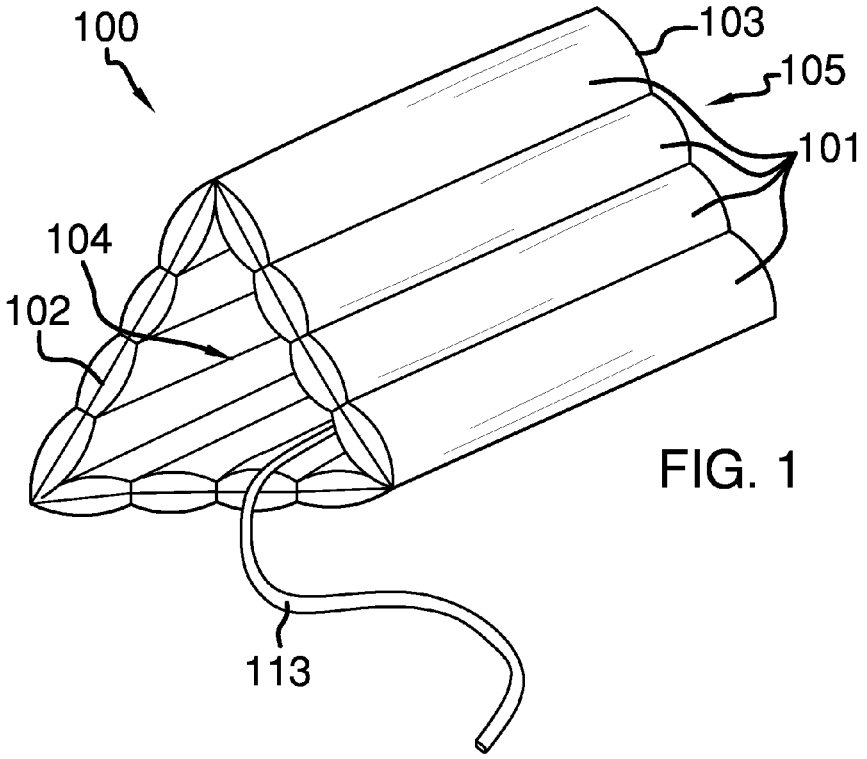
FIG. 1 is a front, perspective view of the personal safety survival device.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 8, the personal safety survival device 100 (hereinafter invention) includes a plurality of elongated inflation members 101 that collectively form a triangularly-shaped enclosure, which is further defined with a first distal end 102, a second distal end 103, a first triangle side 107, a second triangle side 108, and a third triangle side 109. The first distal end 102 includes a first opening 104 whereas the second distal end 103 includes a second opening 105.

The elongated inflation members 101 are individually connected to an auto-inflation system 110, which consists of a CO2 canister 111 and conduit members 112. The conduit members 112 attach to the CO2 canister 111, and connect to each of the plurality of elongated inflation members 101. The CO2 canister 111 is responsible for rapidly inflating all of the plurality of elongated inflation members 101, simultaneously. Moreover, a pull cord 113 is attached to the CO2 canister 111. The pull cord 113 triggers operation of the auto-inflation system 110 such that upon pulling of the pull cord 113, the contents of the CO2 canister 111 are released into the conduit members 112, and subsequently the plurality of elongated inflation members 101.

Figure 3:
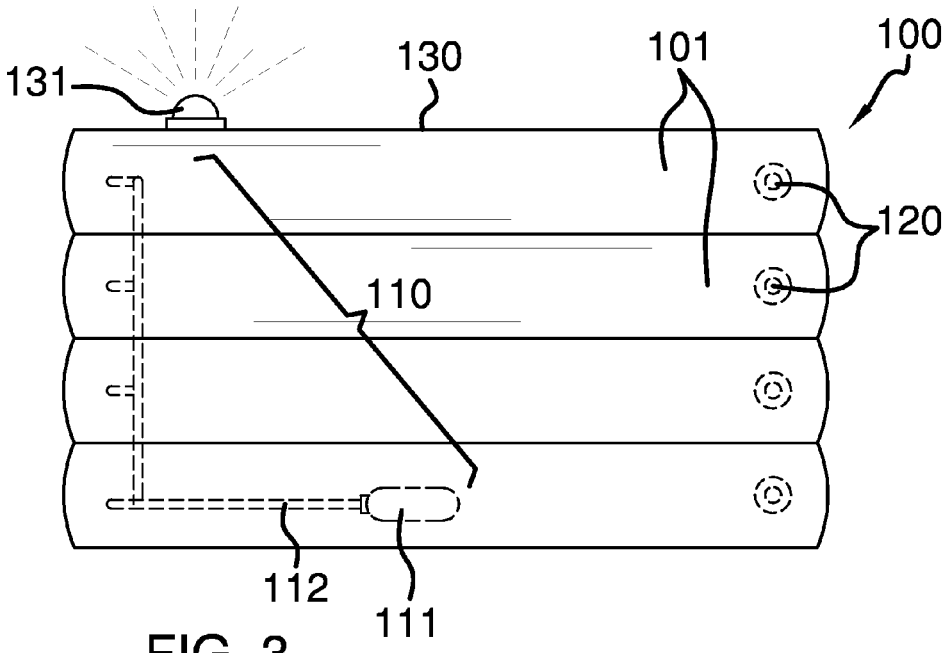
FIG. 3 is a side view of the personal safety survival device.
Figure 4:
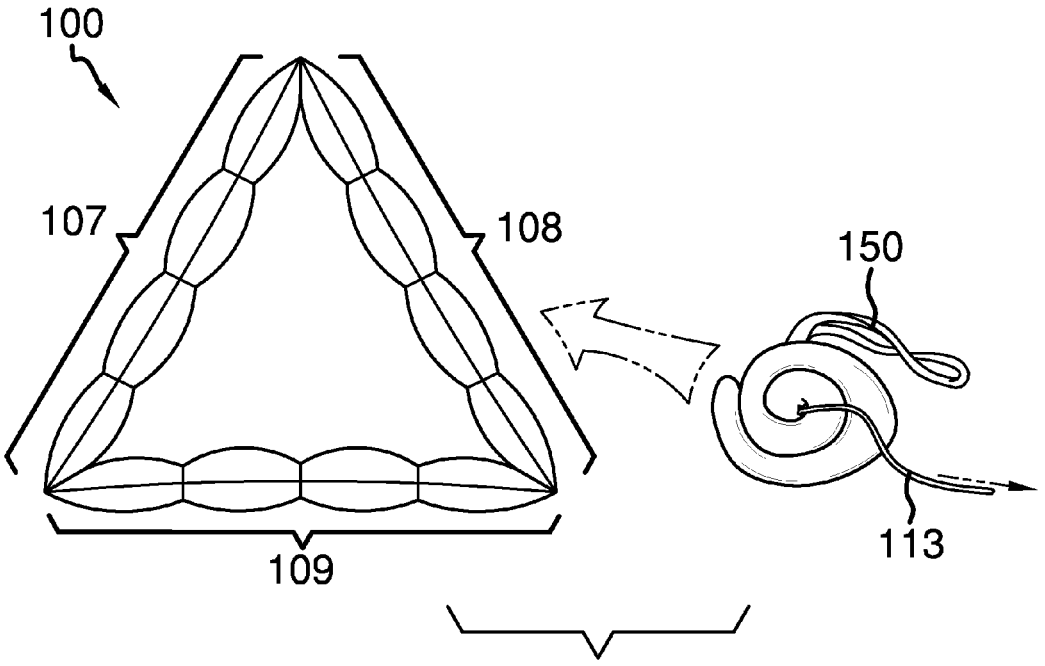
FIG. 4 is a view of the personal safety survival device in a deflated and an inflated condition.
Figure 5:
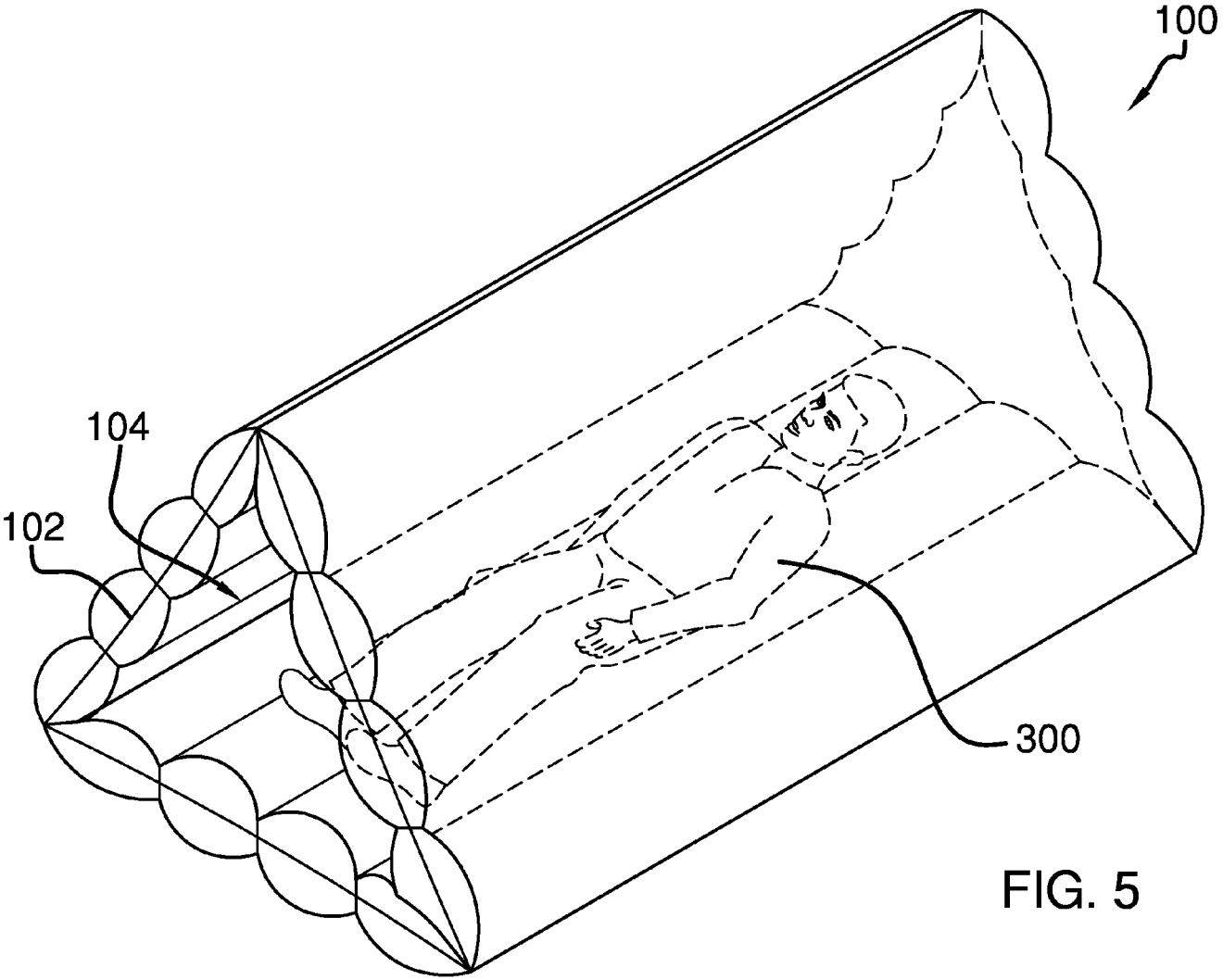
FIG. 5 is another perspective view of the personal safety survival device in use with an end user.

Referring to FIG. 3, the plurality of elongated inflation members 101 each include a nozzle valve 120, which enables the plurality of elongated inflation members 101 to each be manually inflated or manually deflated. The nozzle valve 120 is useful where the plurality of elongated inflation members 101 are not evenly inflated given a prolonged period of time of inflation. The invention 100 may be further defined with an exterior surface 130, which includes at least one beacon member 131 thereon. The beacon member 131 may be further defined as a light emitting diode that intermittently emits light in order to attract attention to a would be stranded end user 300.

Figure 2:
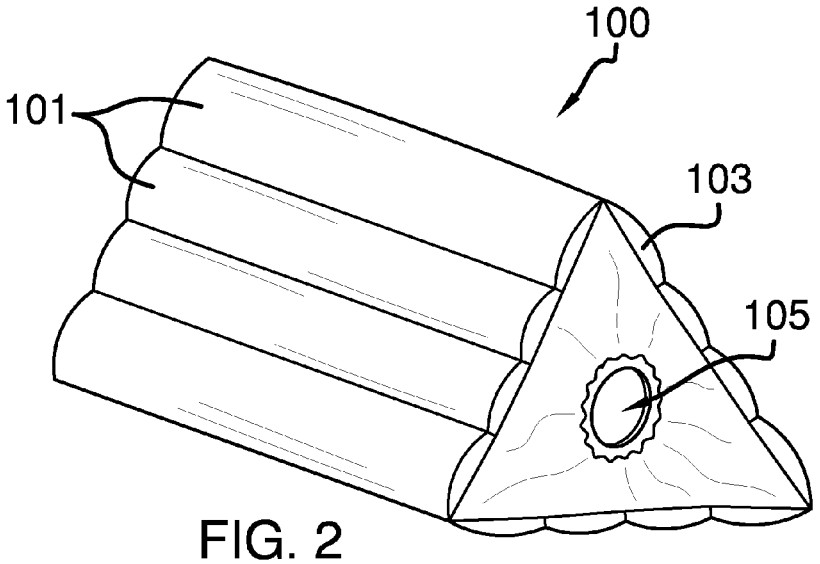
FIG. 2 is a rear, perspective view of the personal safety survival device.
Figure 6:
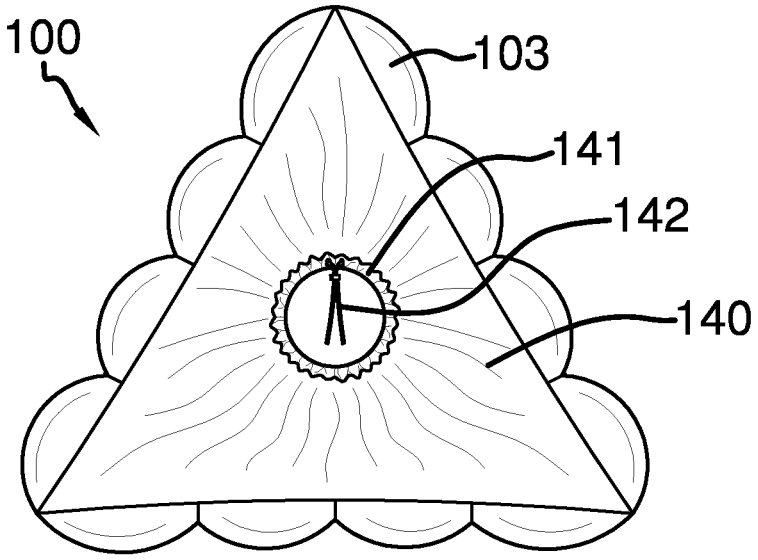
FIG. 6 is a detailed view of a distal end.
Figure 7:
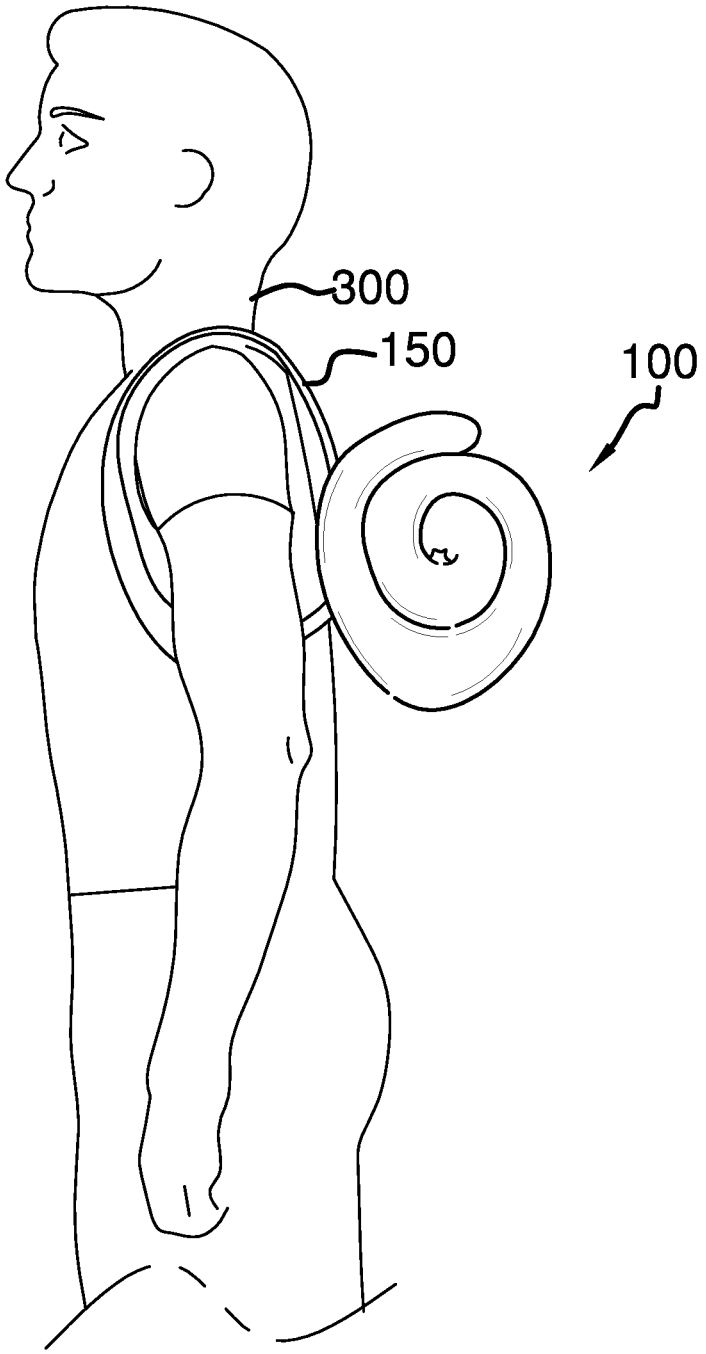
FIG. 7 is a view of the personal safety survival device in a deflated condition and being carried via the strap.
Figure 8:
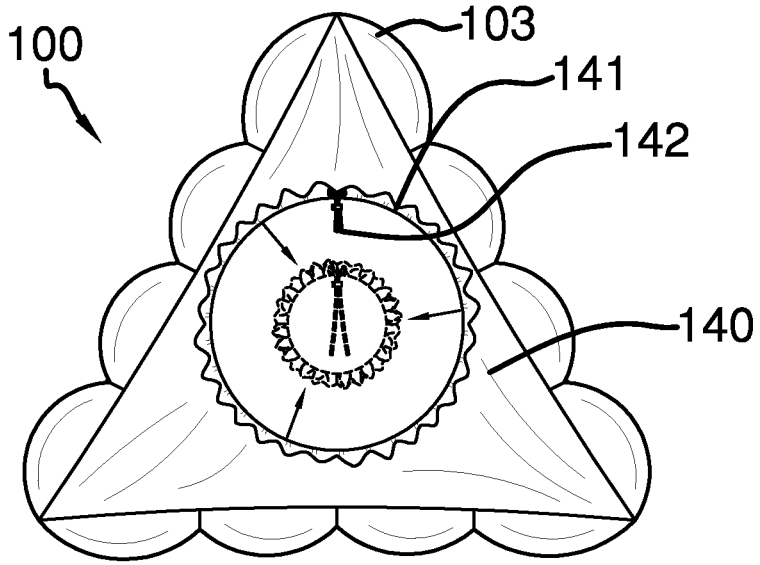
FIG. 8 is a detailed view of the distal end depicting the circular opening shrinking via the drawstring.

Referring to FIGS. 2, 6, and 8, the second distal end 103 may include a curtain member 140. The curtain member 140 is provided on the second opening 105 in order to provide further shade to the end user 300 that is seeking refuge inside of the invention 100. The curtain member 140 features a circular opening 141 that is able to expand and contract in size via a drawstring 142. The ability of the circular opening 141 to expand and contract is desirable when using the invention 100 at various times of day where sunlight exposure varies.

When deflated, the invention 100 is able to be rolled up into a relatively small size, and includes a carrying strap 150. The carrying strap 150 enables the invention 100 to be carried via the end user 200 as needed.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A personal safety survival device comprising:

a triangularly-shaped enclosure that consists of a plurality of elongated inflation members, which when inflated forms a live-saving flotation device for an end user who is stranded on land or sea;

an auto-inflation system is in fluid communication with the plurality of elongated inflation members such that the plurality of elongated inflation members is able to inflate from a deflated condition in order to form said triangularly-shaped enclosure;

wherein the triangularly-shaped enclosure is further defined with a first distal end and a second distal end;

wherein the first distal end includes a first opening whereas the second distal end includes a second opening;

wherein the triangularly-shaped enclosure is further defined with a first triangle side, a second triangle side, and a third triangle side;

wherein the elongated inflation members are individually connected to the auto-inflation system; wherein the auto-inflation system is further defined with a CO2 canister and conduit members; wherein the conduit members attach to the CO2 canister, and connect to each of the plurality of elongated inflation members; wherein the CO2 canister is responsible for rapidly inflating all of the plurality of elongated inflation members, simultaneously;

wherein a pull cord is attached to the CO2 canister; wherein the pull cord triggers operation of the auto-inflation system such that upon pulling of the pull cord, the contents of the CO2 canister are released into the conduit members, and subsequently the plurality of elongated inflation members;

wherein the plurality of elongated inflation members each include a nozzle valve, which enables the plurality of elongated inflation members to each be manually inflated or manually deflated;

wherein the triangularly-shaped enclosure is further defined with an exterior surface, which includes at least one beacon member thereon; wherein said at least one beacon member intermittently emits light in order to attract attention to the personal safety survival device;

wherein a carrying strap is provided with the personal safety survival device in order to carry the personal safety survival device in an deflated condition via the end user;

wherein the exterior surface is painted in a highly reflective color.

2. The personal safety survival device according to claim 1 wherein the second distal end includes a curtain member, which is provided on the second opening in order to provide further shade to the end user situated therein.

3. The personal safety survival device according to claim 2 wherein the curtain member includes a circular opening that is able to expand and contract in size via a drawstring.

4. A personal safety survival device comprising:

a triangularly-shaped enclosure that consists of a plurality of elongated inflation members, which when inflated forms a live-saving flotation device for an end user who is stranded on land or sea;

an auto-inflation system is in fluid communication with the plurality of elongated inflation members such that the plurality of elongated inflation members is able to inflate from a deflated condition in order to form said triangularly-shaped enclosure;

wherein the triangularly-shaped enclosure is further defined with a first distal end and a second distal end;

wherein the first distal end includes a first opening whereas the second distal end includes a second opening;

wherein the triangularly-shaped enclosure is further defined with a first triangle side, a second triangle side, and a third triangle side;

wherein the elongated inflation members are individually connected to the auto-inflation system;

wherein the auto-inflation system is further defined with a CO2 canister and conduit members; wherein the conduit members attach to the CO2 canister, and connect to each of the plurality of elongated inflation members; wherein the CO2 canister is responsible for rapidly inflating all of the plurality of elongated inflation members, simultaneously;

wherein a pull cord is attached to the CO2 canister; wherein the pull cord triggers operation of the auto-inflation system such that upon pulling of the pull cord, the contents of the CO2 canister are released into the conduit members, and subsequently the plurality of elongated inflation members;

wherein the plurality of elongated inflation members each include a nozzle valve, which enables the plurality of elongated inflation members to each be manually inflated or manually deflated;

wherein the triangularly-shaped enclosure is further defined with an exterior surface, which includes at least one beacon member thereon; wherein said at least one beacon member intermittently emits light in order to attract attention to the personal safety survival device;

wherein the exterior surface is painted in a highly reflective color;

wherein the second distal end includes a curtain member, which is provided on the second opening in order to provide further shade to the end user situated therein;

wherein the curtain member includes a circular opening that is able to expand and contract in size via a drawstring;

wherein a carrying strap is provided with the personal safety survival device in order to carry the personal safety survival device in an deflated condition via the end user.

* * * * *